US007088319B2

(12) United States Patent
Yoshida et al.

(10) Patent No.: US 7,088,319 B2
(45) Date of Patent: Aug. 8, 2006

(54) DRIVE METHOD OF LIGHT-EMITTING DISPLAY PANEL AND ORGANIC EL DISPLAY DEVICE

(75) Inventors: Takayoshi Yoshida, Yonezawa (JP); Masaki Murakata, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 378 days.

(21) Appl. No.: 10/253,719

(22) Filed: Sep. 25, 2002

(65) Prior Publication Data

US 2003/0160744 A1 Aug. 28, 2003

(30) Foreign Application Priority Data

Feb. 27, 2002 (JP) ..... 2002-050930

(51) Int. Cl.
*G09G 3/30* (2006.01)
*G09G 3/32* (2006.01)

(52) U.S. Cl. ..... 345/82; 345/76

(58) Field of Classification Search ..... 345/76–85, 345/90–93, 95, 98–100
See application file for complete search history.

(56) References Cited

U.S. PATENT DOCUMENTS 5,936,599 A * 8/1999 Reymond ..... 345/82
6,339,414 B1 * 1/2002 Todokoro et al. ..... 345/75.1
6,498,596 B1 * 12/2002 Nakamura et al. ..... 345/98
6,608,614 B1 * 8/2003 Johnson ..... 345/102
2001/0052891 A1 * 12/2001 Yoshihara et al. ..... 345/102
2002/0011978 A1 * 1/2002 Yamazaki et al. ..... 345/87
2005/0041010 A1 * 2/2005 Komoto et al. ..... 345/102

OTHER PUBLICATIONS

Patent Abstracts of Japan Publication No. 09-232074 dated Sep. 5, 1997 Discussed in the specification.

* cited by examiner

*Primary Examiner*—Vijay Shankar
(74) *Attorney, Agent, or Firm*—Westerman, Hattori, Daniels & Adrian, LLP.

(57) ABSTRACT

Light-emitting elements disposed on a light-emitting display panel are driven by constant currents, and the forward direction voltages of the light-emitting elements are obtained by a sampling/holding circuit. Then, the voltage output from a drive voltage source composed of a DC-DC converter is controlled by the forward direction voltages obtained by the sampling/holding circuit. For example, when the light-emitting display panel starts to be driven for light emission or when the light emission luminance of the light-emitting display panel that is being driven for light emission is to be increased, a control signal is sent from a light emission control circuit to a voltage forcibly changing circuit which supplies an output voltage increase command to the PWM circuit of the drive voltage source. With this arrangement, the rising-up property of the light-emitting display panel and the following property of luminance can be improved.

20 Claims, 7 Drawing Sheets

【FIG. 1】
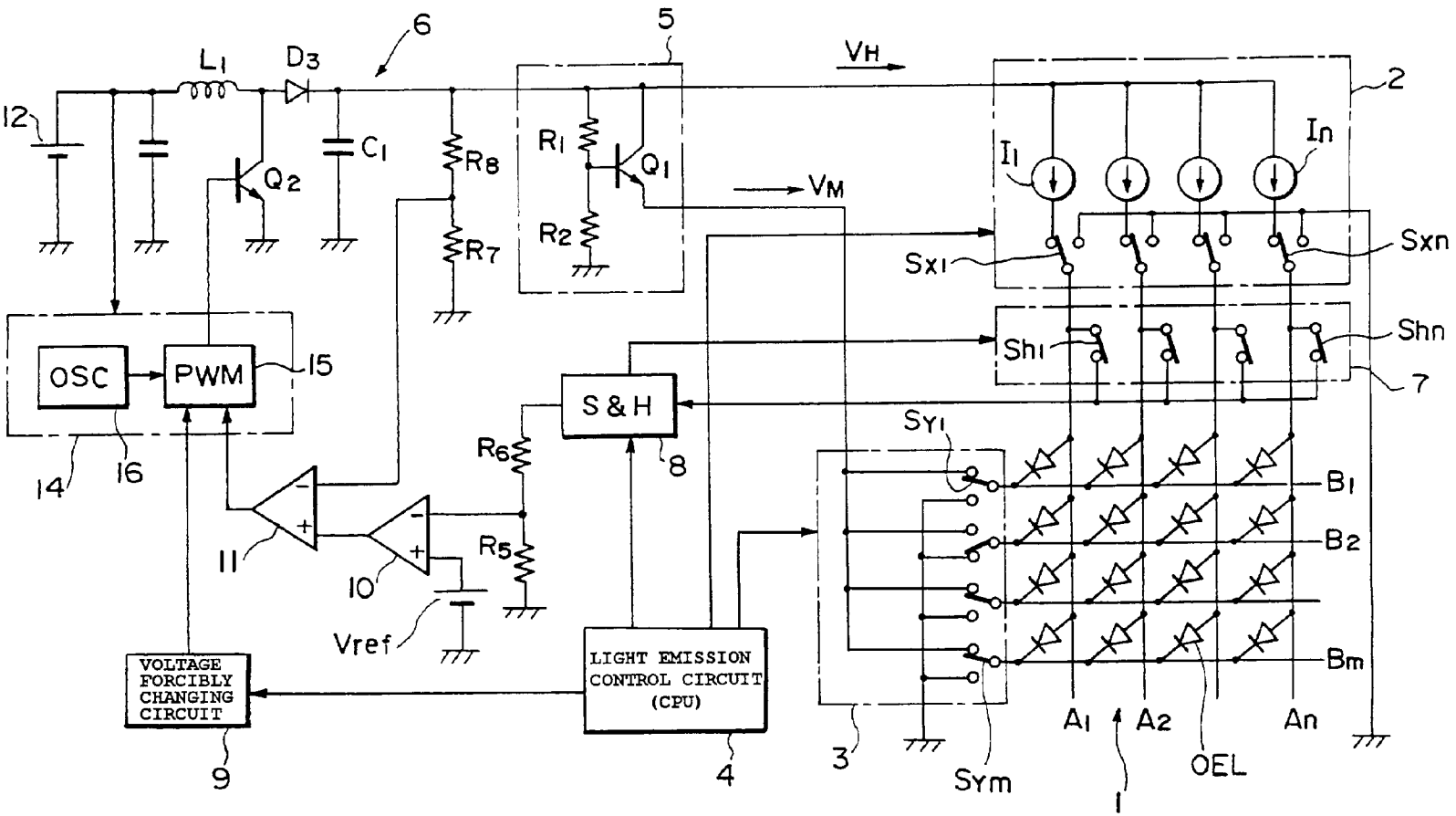

【FIG. 2】
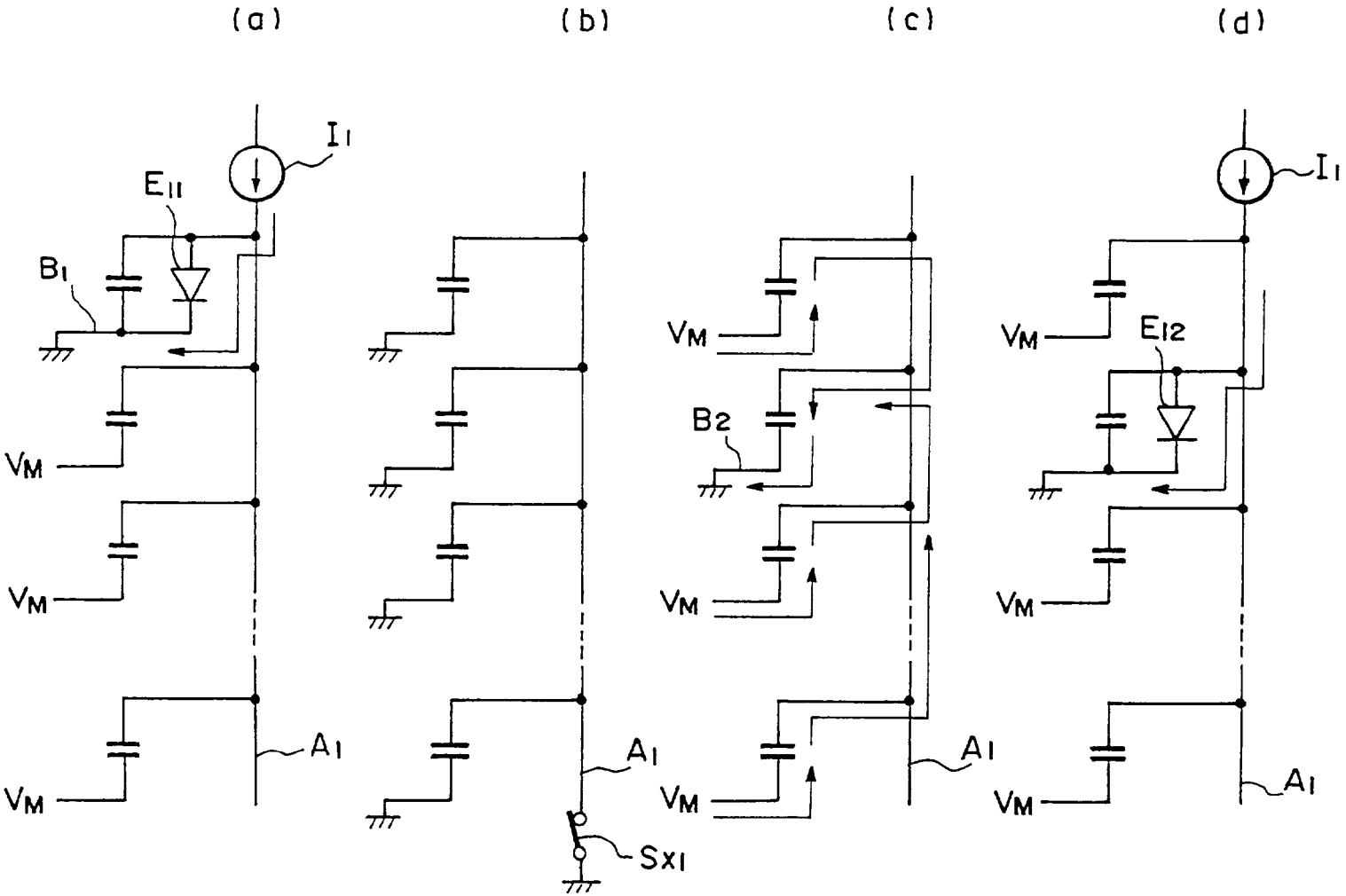

【FIG. 3】
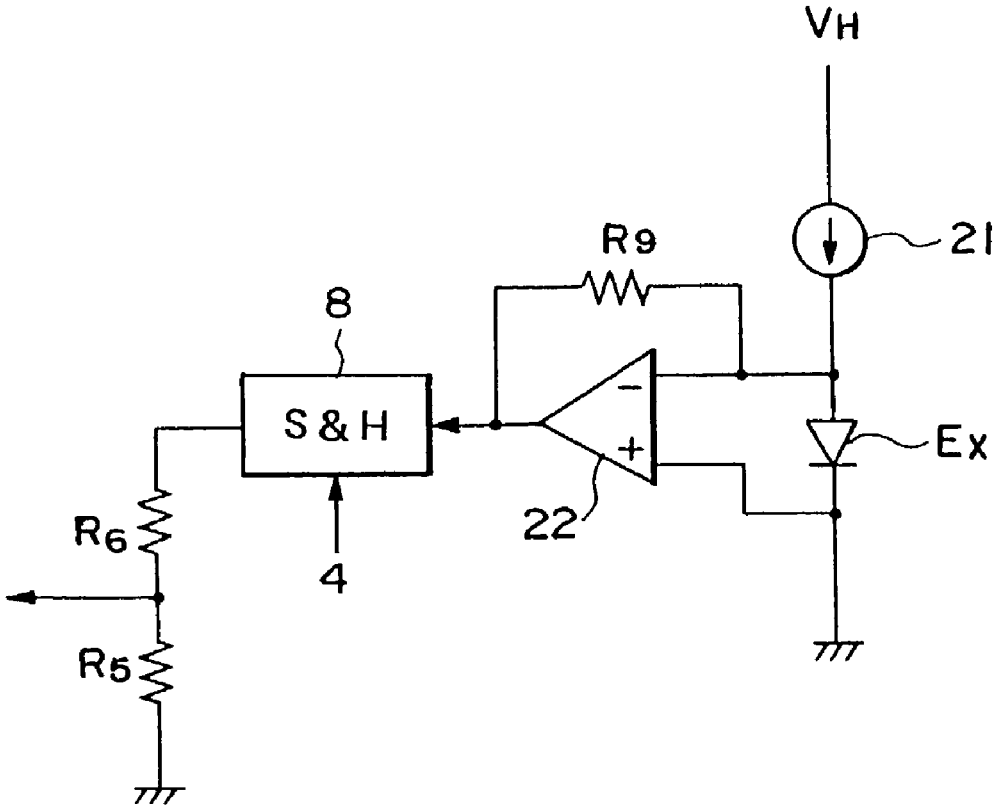

【FIG. 4】
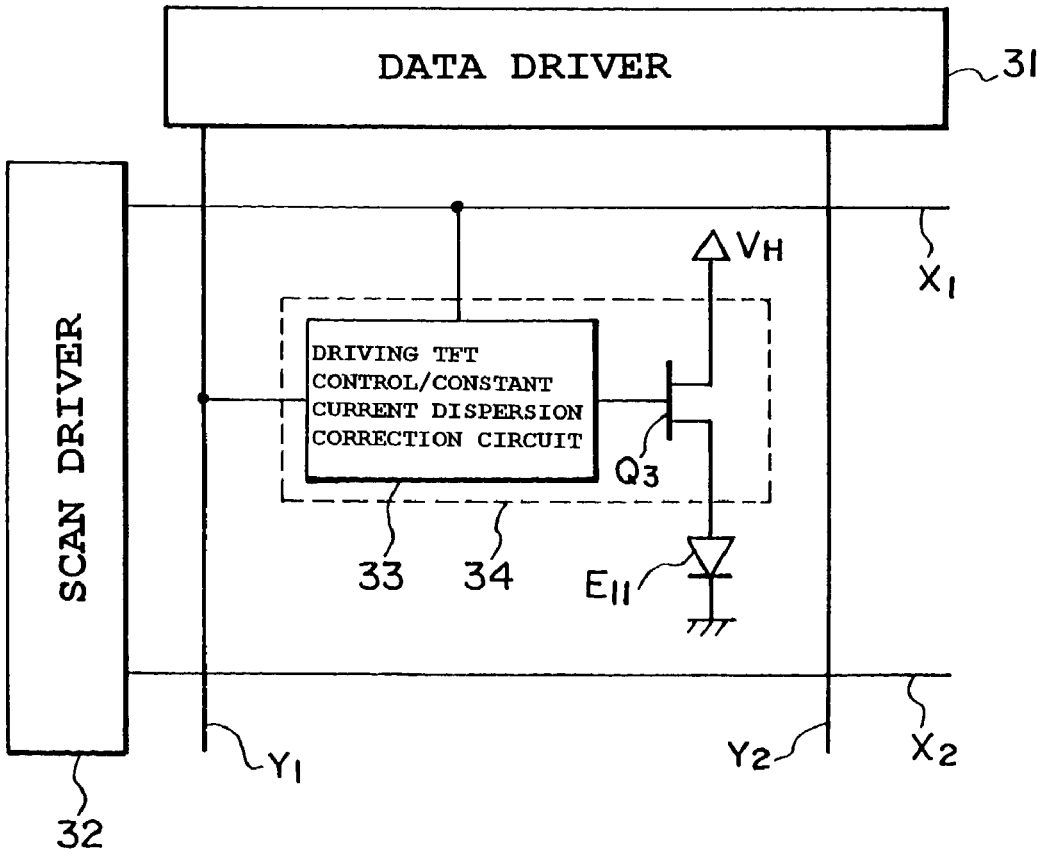

【FIG. 5】 【Prior Art】
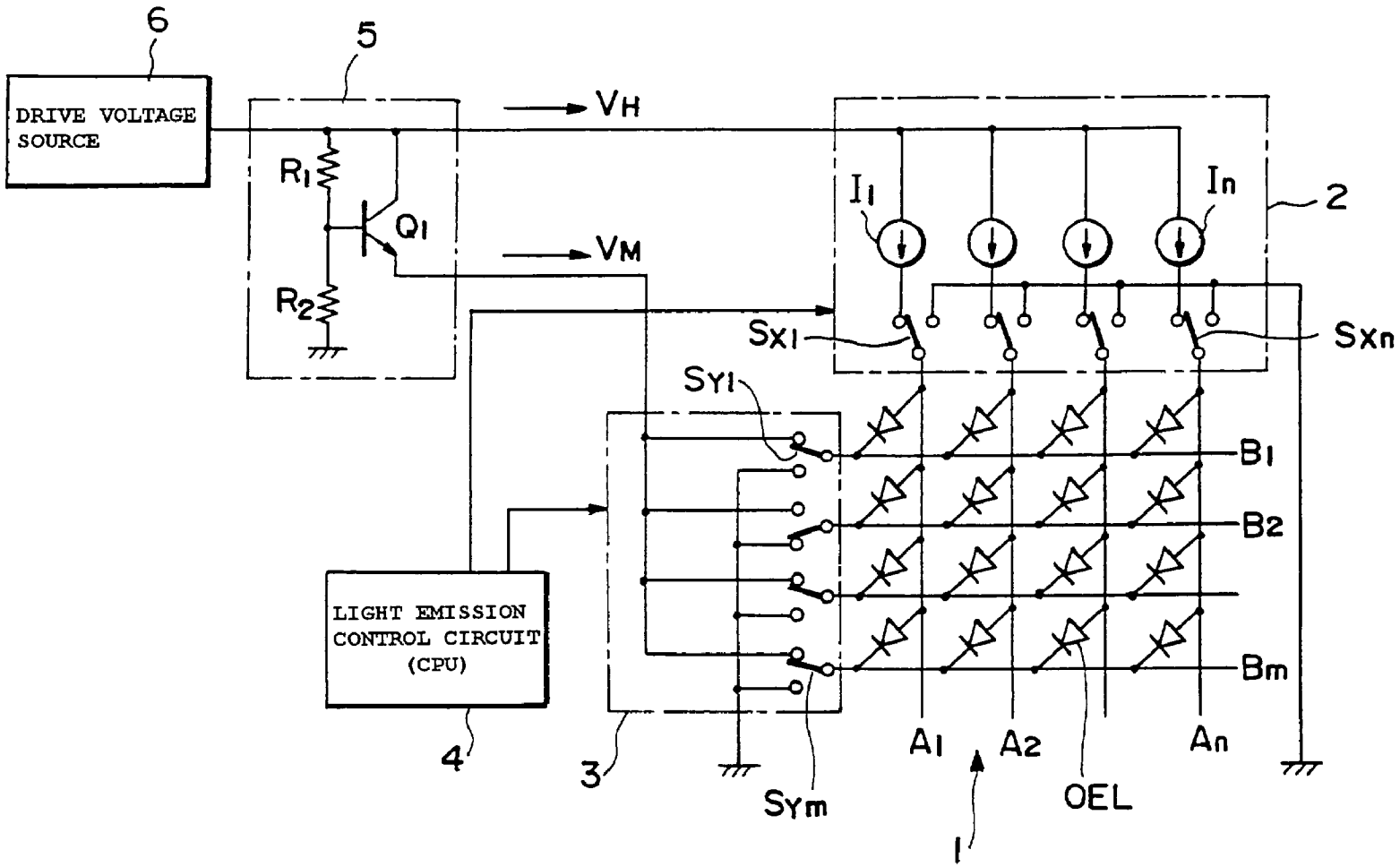

【FIG. 6】
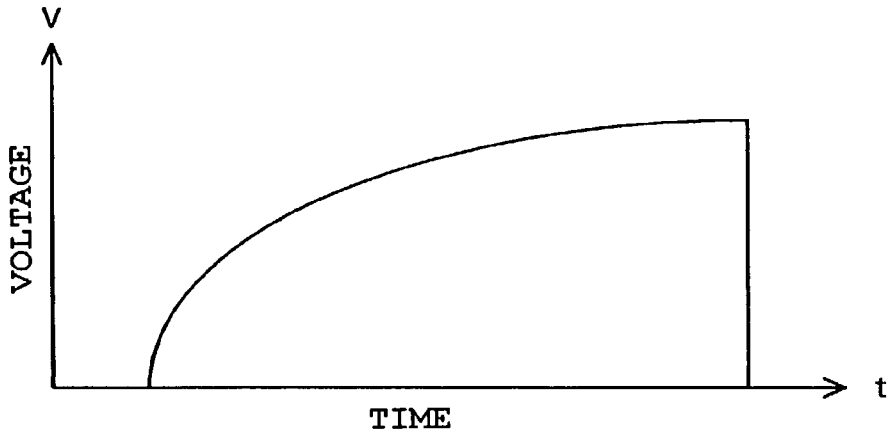
【FIG. 7】
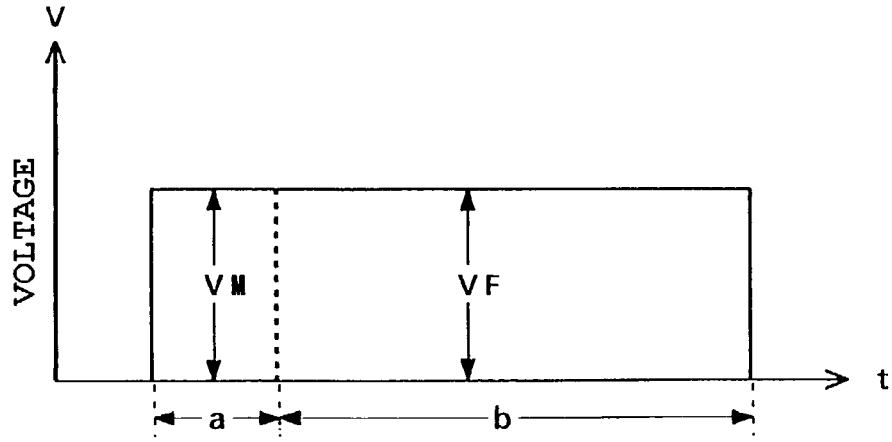
【FIG. 8】
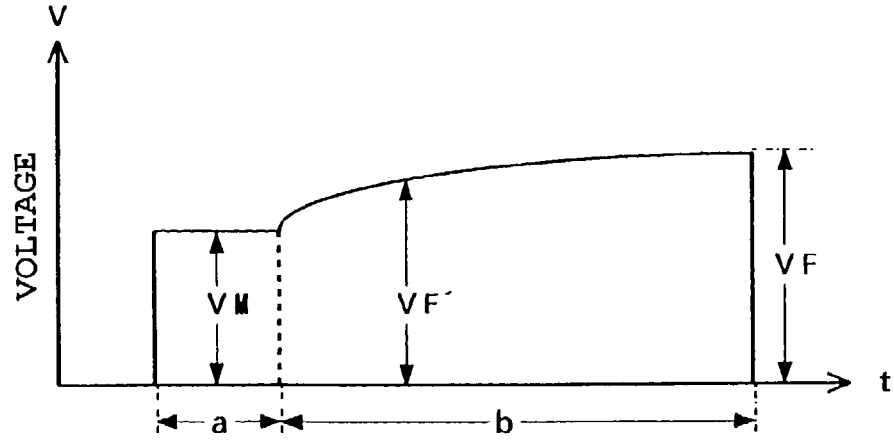

【FIG. 9】
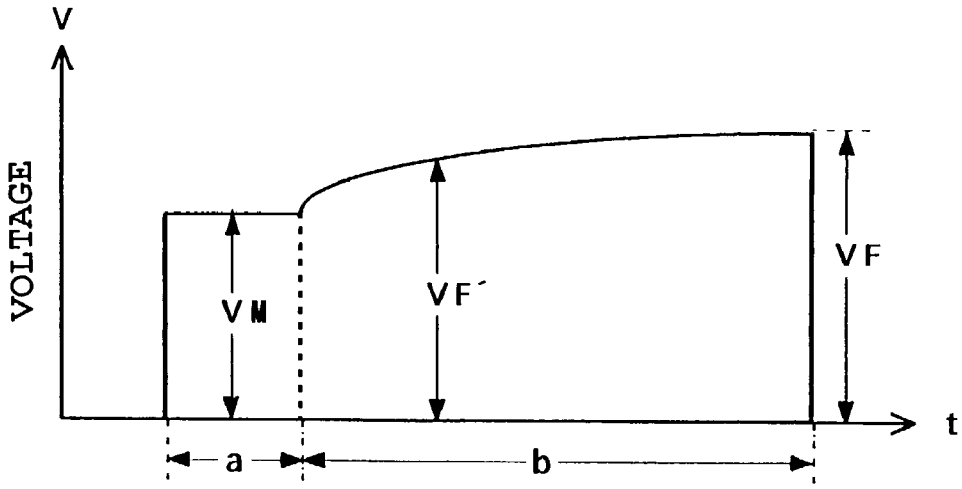
【FIG. 10】
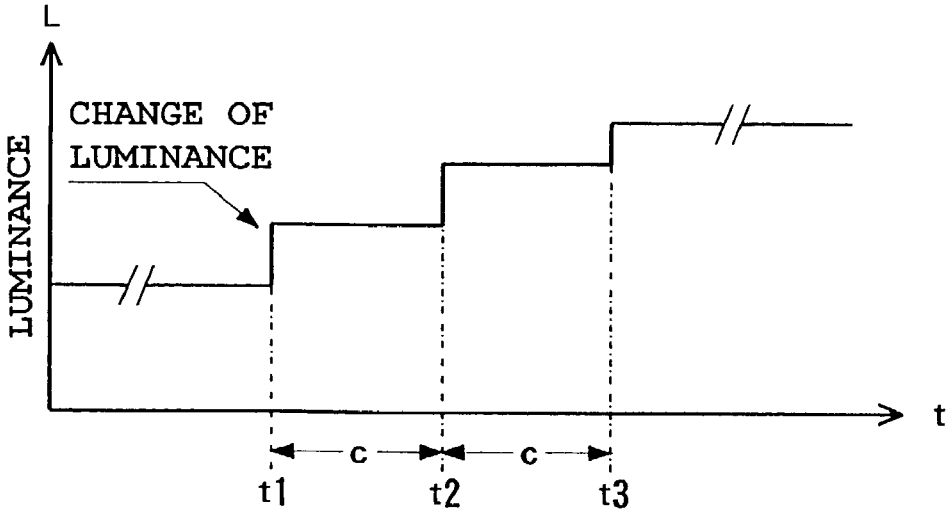

DRIVE METHOD OF LIGHT-EMITTING DISPLAY PANEL AND ORGANIC EL DISPLAY DEVICE

BACKGROUND OF THE INVENTION

1. Field of the Invention

The present invention relates to a drive method of a light-emitting display panel using, for example, organic electroluminescence (EL) elements acting as light-emitting elements and to a display device using the light-emitting display panel, and more particularly, to a light emission luminance control technology for causing, when the light-emitting display panel starts to be driven for light emission or when it is intended to increase light emission luminance while the light-emitting display panel is being driven for light emission, light emission to rise up instantly or light emission luminance to increase instantly following the above operation or intention.

2. Description of the Related Art

Attention is given to an organic EL display as a successor of a liquid crystal display because the organic EL display can reduce power consumption, can display an image of high quality and further can be reduced in thickness. This is because the efficiency and life of the organic EL display have been improved to a practically usable level by using an organic compound promising good light emitting characteristics for the light-emitting layers of EL elements used in the EL display.

There have been proposed a passive matrix drive system and an active matrix drive system as a drive method of a display panel in which the EL elements are disposed. FIG. 5 shows the passive matrix drive system and an example of the display panel whose light emission is controlled by the passive matrix drive system. Two drive methods, that is, a cathode line scan/anode line drive method and an anode line scan/cathode line drive method are available as a drive method of the EL elements in the passive matrix drive system. FIG. 5 shows the arrangement of the former cathode line scan/anode line drive method.

That is, the display panel is arranged such that anode lines $A_1$ to $A_n$ are disposed in a vertical direction as n-pieces of drive lines, whereas cathode lines $B_1$ to $B_m$ are disposed in a horizontal direction as m-pieces of scan lines, and organic EL elements OEL shown by the symbol of diode are disposed at the intersections (n×m positions in total) of the respective lines. Then, the respective EL elements as light-emitting elements constituting pixels are disposed in a lattice shape, and one ends thereof (anode terminals of the EL elements) are connected to the anode lines and the other ends thereof (cathode terminals of the EL elements) are connected to the cathode lines in correspondence to the intersections between the anode lines $A_1$ to $A_n$ along the vertical direction and the cathode lines $B_1$ to $B_m$ along the horizontal direction. Further, the anode lines are connected to an anode line drive circuit 2, and the cathode lines are connected a cathode line scan circuit 3 so as to be driven respectively.

The scan circuit 3 has scan switches $S_{y1}$ to $S_{ym}$ in correspondence to the respective cathode scan lines $B_1$ to $B_m$. The scan switches $S_{y1}$ to $S_{ym}$ act to supply any one of a reverse bias voltage $V_M$ supplied from a reverse bias voltage creation circuit 5 to prevent the crosstalk light emission of the elements and a ground potential acting as a reference potential to corresponding cathode can lines. Further, the anode line drive circuit 2 has constant current circuits $I_1$ to $I_n$ for supplying drive currents to the respective EL elements through the respective anode lines and drive switches $S_{X1}$ to $S_{Xn}$.

The drive switches $S_{X1}$ to $S_{Xn}$ act to supply any one of the currents from the constant current circuits $I_1$ to $I_n$ and the ground potential to corresponding anode lines. Accordingly, when the drive switches $S_{X1}$ to $S_{Xn}$ are connected to the constant current circuits, they supply the currents from the constant current circuits $I_1$ to $I_n$ to the respective EL elements disposed in correspondence to the cathode scan lines.

Note that it is possible to use a voltage source such as constant voltage circuits, and the like in place of the constant current circuits. However, the constant current circuits are ordinarily used as shown in FIG. 5 because of the reasons that the voltage/luminance characteristics of the EL elements are unstable to a temperature change while the current/luminance characteristics thereof are stable to the temperature change, that there is a possibility that the EL elements are deteriorated by an excessive current, and the like.

A light emission control circuit 4 including a CPU is connected to the anode line drive circuit 2 and to the cathode line scan circuit 3 through control buses, and the scan switches $S_{Y1}$ to $S_{Ym}$ and the drive switches $S_{X1}$ to $S_{Xn}$ are manipulated based on the signals of an image to be displayed. With this arrangement, the constant current circuits $I_1$ to $I_n$ are appropriately connected to desired anode lines while setting the cathode scan lines to the ground potential at a predetermined cycle based on the image signals. Accordingly, the respective EL light-emitting elements selectively emit light, thereby the image is reproduced on the display panel 1 based on the image signals.

A DC output (output voltage=$V_H$) from a drive voltage source 6 composed of, for example, a voltage increasing type DC-DC converter is supplied to the respective constant current circuits $I_1$ to $I_n$ of the anode line drive circuit 2. With this arrangement, the constant currents created by the constant current circuits $I_1$ to $I_n$, to which the output voltage $V_H$ has supplied from the drive voltage source 6, are supplied to the respective EL elements disposed in correspondence to the anode scan lines.

In contrast, the value of the reverse bias voltage $V_M$ used to prevent the crosstalk light emission of the EL elements is ordinarily generated by series regulating the output voltage $V_H$ because the voltage $V_M$ is relatively near to the value of the output voltage $V_H$ and the current consumed by the reverse bias voltage $V_M$ is smaller than that of the output voltage $V_H$. Thus, it is considered that the employment of the above arrangement is advantageous from the view point of the number of parts and power consumption.

A reverse bias voltage creation circuit 5 having a simple arrangement shown in FIG. 5 can be preferably employed as the series regulating circuit. The reverse voltage creation circuit 5 is composed of a voltage division circuit for dividing the output voltage $V_H$ from the drive voltage source 6 and a transistor $Q_1$ for outputting the divided voltage created by the voltage division circuit as a reverse bias voltage by subjecting it to impedance transformation. That is, the voltage division circuit is composed of resistors $R_1$ and $R_2$ connected in series between the drive voltage source 6 and the reference potential (ground), and the collector terminal of the npn transistor $Q_1$ that achieves the impedance transformation function is connected to the drive voltage source 6, and the base terminal thereof is connected to the node between the resistors $R_1$ and $R_2$. With this arrangement, the transistor $Q_1$ is in an emitter follower connection, and the reverse bias voltage $V_M$ is output from the emitter terminal of the transistor $Q_1$.

Incidentally, according to the drive unit arranged as described above, the constant current circuits are provided in correspondence to the respective anode lines to drive the respective EL elements by the constant currents. In the constant current circuits, a certain amount of voltage drop must be taken into consideration in the circuits to drive the respective EL elements by the constant voltage at all times. Accordingly, the output voltage $V_H$ from the drive voltage source 6, which is supplied to the constant current circuits, must have a voltage value equal to or larger than the voltage value obtained by adding the amount of voltage drop arisen in the constant current circuits to the forward direction voltages $V_F$ of the respective EL elements driven by the constant currents.

Moreover, when the electric dispersion and deterioration with age of the respective EL elements and further the dispersion of the respective elements in the constant current circuits are taken into consideration, it is necessary to set the output voltage $V_H$ by further adding a predetermined margin to the amount of voltage drop in the constant current circuits. When this margin is added, the amount of voltage drop is made excessive in almost all the constant current circuits, thereby a problem is arisen in that a power loss is increased in the constant current circuits.

Thus, it is contemplated to detect the forward direction voltage $V_F$ of each EL element driven by the constant current by, for example, a sampling and holding means and to control the value of the output voltage $V_H$ supplied from the drive voltage source 6 based on the thus detected forward direction voltage $V_F$. When the control means described above is employed, it is possible to create the output voltage $V_H$ by adding a given voltage value, which can guarantee that each EL element is driven by the constant voltage in the constant current circuits, to the forward direction voltage $V_F$. Accordingly, it is possible to set the margin to a very small amount so as to reduce the power loss in the constant current circuits. With this arrangement, when this drive method is used in, for example, mobile appliances, and the like, the power consumption of batteries can be reduced.

In contrast, it is known that the organic EL elements described above have diode characteristics including a predetermined electric capacitance (parasitic capacitance) from the laminated structure thereof. Then, when the organic EL elements are driven by constant currents as described above, the anode voltage waveform of the elements has such a characteristic that it slowly rises up as shown in FIG. 6 because the constant current circuits are high impedance output circuits in the operation principle thereof. That is, in FIG. 6, a vertical axis shows the anode voltage V of an element, and a lateral axis shows an elapsed time t.

The rising-up curve of the anode voltage V is changed by various conditions such as the lighting/non-lighting condition of the element when it was scanned last time, the lighting/non-lighting condition of an adjacent element, and the like. Then, the luminance of the organic EL element is also changed by the change of the rising-up curve. However, the substantial luminance of the display panel cannot help being dropped because the rising-up of the light emission of the element is delayed.

To cope with this problem, there is proposed a drive method of connecting a constant voltage source to an element when the element is driven for light emission and providing a precharge period during which the parasitic capacitance of the element is instantly charged. There is available a cathode reset method as a typical drive method of executing the precharge and is disclosed in, for example, JP 09-232074 A. According to this cathode reset method, it is possible to instantly rise the anode voltage of an EL element to be lit to a voltage near to the reverse bias voltage $V_M$ for preventing the crosstalk light emission by making use of the parasitic capacitance of the EL elements and the reverse bias voltage $V_M$.

FIG. 7 shows an anode voltage waveform when a precharge voltage ($V_M$) is set equal to the forward direction voltage ($V_F$) of an element. A vertical axis shows the anode voltage V of an element, and a lateral axis shows an elapsed time t also in FIG. 7. In FIG. 7, a period a shows a precharge period to the element and a period b shows a constant current drive period of the element.

Then, the following problem is arisen when the precharge drive as described above is executed as well as when the control means described above is employed to obtain the forward direction voltage $V_F$ of each EL element by making use of, for example, the sampling and holding means and to control the value of the output voltage $V_H$ supplied from the drive voltage source 6 using the forward direction voltage $V_F$. That is, when the light emission luminance of a light-emitting element, which is being lit for light emission, is increased, the forward direction voltage $V_F$ of the element increases as shown in FIG. 8. At this time, a final forward direction voltage $V_F$ cannot be sampled and held depending on timing of a sampling operation and a voltage denoted by $V_F'$ is held based on the timing of the sampling operation, and the output voltage $V_H$ of the drive voltage source 6 is controlled based on the thus held voltage $V_F'$.

Since the voltage $V_M$ used for the precharge is created based on the output voltage $V_H$ from the drive voltage source 6, a higher precharge voltage $V_M$ shown in FIG. 9 is created next based on the held voltage $V_F'$ shown in FIG. 8. Accordingly, the luminance of the EL element does not increase instantly but increase stepwise as shown in FIG. 10. Thus, a problem is arisen in that the slow change of luminance as described above is felt unnatural by a user. Note that $t_1$, $t_2$, and $t_3$ in FIG. 10 show timing at which a sampling operation is executed, and c shows sampling intervals.

Further, even if the precharge as described above is not executed and the light-emitting elements are driven by the constant current, luminance changes slowly likewise. That is, when light emission luminance is increased and the forward direction voltages $V_F$ are increased, the voltage $V_H$ output from the drive voltage source 6 is a previous voltage until sample hold timing for detecting the forward direction voltages $V_F$ arrives. Thus, the difference of potential between the voltage $V_H$ and the voltage $V_F$ is reduced and the constant current circuits for driving the respective light-emitting elements by the constant current cannot execute a constant current supply operation. As a result, while the luminance of the light-emitting elements increase, the predetermined luminance thereof cannot be reached.

When the sample hold timing for detecting the voltage $V_F$ arrives, the voltage $V_H$ is controlled to a higher voltage and the constant current circuits also can execute the constant current supply operation up to a higher voltage $V_F$, thereby the luminance is increased. The repetition of the above operation causes the luminance to reach a predetermined value stepwise. With the above operation, the luminance changes slowly likewise with a result that the user has unnatural feeling. Further, this defect is arisen in the same way also when, for example, the display panel starts to be driven for light emission.

The phenomenon described above is mainly caused by the sampling intervals of the sampling and holding operation (which ordinarily operates at the intervals of several hundreds of milliseconds). Accordingly, it is conceived to execute the sampling and hold operation at timing of short intervals (for example, at the intervals of several tens of milliseconds). However, when the sampling and holding operation is executed at the timing of the short intervals at all times, a drive power necessary to the sampling and holding operation and the voltage held by the operation are discharged each time the operation is executed, thereby a power is wasted. Therefore, when this drive method is used in, for example, mobile terminals, and the like, the power of the batteries thereof is wasted, and thus this drive method is not preferable.

SUMMARY OF THE INVENTION

An object of the present invention, which was made in view of the above technical view of point, is to provide a drive method of a light-emitting display panel capable of improving the slow rising-up operation of light emission luminance generated, for example, when the light emission luminance of a display panel is increased as described above or when the display panel starts to be driven for light emission as well as capable of reducing driving electric power and to provide an organic EL display device using the drive method.

A drive method of a light-emitting display panel according to the present invention made to achieve the object described above and including light-emitting elements whose lighting is controlled through constant current circuits has a feature in the steps of supplying constant currents to the light-emitting elements from the constant current circuits making use of the voltage output from a drive voltage source, controlling the voltage output from the drive voltage source based on the forward direction voltages of the light-emitting elements, and forcibly changing the voltage output from the drive voltage source according to the change of the drive conditions of the light-emitting elements.

In this case, when the light-emitting display panel starts to be driven for light emission, it is preferable that the voltage output from the drive voltage source be forcibly changed to a predetermined voltage value. It is preferable that the voltage output from the drive voltage source be forcibly changed to a predetermined voltage value also when the light emission luminance of the light-emitting display panel that is being drive for light emission is to be increased. Further, it is also conceived that the voltage output from the drive voltage source be forcibly changed to a predetermined voltage value when the light emission luminance of the light-emitting display panel that is being driven for light emission is to be increased beyond a predetermined range.

When any of the control modes described above is employed, it is preferable that the predetermined voltage value be set to a maximum value of an output voltage that can be generated from the voltage drive source. Further, the predetermined voltage value may be set to a voltage value predetermined in correspondence to a degree of increase of light emission luminance.

In the preferable embodiments in which the control modes described above are embodied, the forward direction voltages may be sampled at the timing at which the constant currents are supplied from the constant current circuits to the light-emitting elements, and the forward direction voltages are obtained by a sampling/holding circuit for holding the sampled voltage values. Further, the forward direction voltages may be obtained by adding a constant current to a dummy light-emitting element that does not contribute to the light emission of the light-emitting display panel.

In addition to the above, it is preferable that a voltage drop in the constant current circuits be controlled substantially constant by controlling the voltage output from the drive voltage source. It is preferable that a voltage increasing type DC-DC converter be used as the drive voltage source.

In a display device according to the present invention, the light-emitting elements may be composed of organic EL elements that are driven for light emission by employing any of the drive methods described above.

According to the display device employing the drive methods described above, since the voltage output from the drive voltage source is controlled by detecting the forward direction voltages of the light emission elements supplied through the constant current circuits, the constant current circuits for supplying constant currents to the respective EL elements can minimize the voltage drop thereof within the range in which a constant current supply operation can be secured. Accordingly, this arrangement can contribute to the reduction of electric power loss in the constant current circuits.

Further, the voltage output from the drive voltage source is forcibly changed to a voltage value having a predetermined magnitude, for example, when the light-emitting display panel starts to be driven for light emission, the rising-up characteristics of the light emission luminance of the light-emitting display panel can be made steep. Further, when the light emission luminance of the light-emitting display panel is to be increased, the light emission luminance set to the display panel can be changed instantly because the output voltage from the drive voltage source is forcibly controlled to the voltage value having the predetermined magnitude.

BRIEF DESCRIPTION OF THE DRAWINGS

FIG. 1 is a wiring diagram showing a display panel drive unit employing a drive method according to the present invention in a passive matrix drive system;

FIG. 2 is a wiring diagram explaining a cathode reset operation used in the drive unit shown in FIG. 1;

FIG. 3 is a wiring diagram showing an example using a dummy organic EL element to obtain a forward direction voltage of a light-emitting element;

FIG. 4 is a wiring diagram showing an example when the drive method according to the present invention is employed in an active matrix drive system;

FIG. 5 is a wiring diagram showing an example of a conventional light emission drive unit according to a conventional passive matrix drive system;

FIG. 6 is a characteristic view showing a rising-up state of an anode voltage in a light-emitting element driven by a constant voltage;

FIG. 7 is a characteristic view showing an anode voltage when precharge is executed to a light-emitting element;

FIG. 8 is a characteristic view showing a change of a forward direction voltage when the light emission luminance of a light-emitting element, which is being driven for light emission, is dropped;

FIG. 9 is a characteristic view showing a further change of the forward direction voltage of the light-emitting element subsequent to the change shown in FIG. 8; and FIG. 10 is a characteristic view showing an example of a change of luminance when the luminance of a light-emitting elements is increased.

DESCRIPTION OF THE PREFERRED EMBODIMENTS

A display device employing a drive method according to the present invention will be explained as to a preferable embodiment thereof with reference to the figures. FIG. 1 shows a passive matrix drive system to which the present invention is applied and an example of a display panel the light emission of which is controlled by the passive matrix drive system. Note that, in FIG. 1, a display panel 1, an anode line drive circuit 2, a cathode line scan circuit 3, and a light emission control circuit 4 that drive the display panel 1, and further a reverse bias voltage creation circuit 5 have the same functions as the respective circuits shown in FIG. 5 described above, and thus the detailed description thereof is appropriately omitted.

Note that, in this embodiment, data for opening and closing drive switches $S_{X1}$ to $S_{Xn}$ is sent from the light emission control circuit 4 to the anode line drive circuit 2 through a control bus connecting the light emission control circuit 4 to the anode line drive circuit 2 as well as current control data capable of controlling the currents output from respective constant current circuits $I_1$ to $I_n$ is also sent to the anode line drive circuit 2. With this arrangement, it is possible to change the light emission luminance of the display panel 1 in response to a command from the light emission control circuit 4.

In FIG. 1, a sampling switch 7 is interposed between the anode line drive circuit 2 and the display panel 1. The sampling switch 7 includes respective switches denoted by $Sh_1$ to $Sh_n$ in correspondence to respective drive switches $S_{X1}$ to $S_{Xn}$ in the anode line drive circuit 2 and to anode lines $A_1$ to $A_n$ in the display panel 1. These switches $Sh_1$ to $Sh_n$ are opened and closed in response to a control signal from a sampling/holding circuit 8.

That is, the light emission control circuit 4 drives the sampling/holding circuit 8 in synchronism with that the light the respective EL elements are controlled to be lit through the respective drive switches $S_{X1}$ to $S_{Xn}$ to thereby close the respective switches $Sh_1$ to $Sh_n$. Then, the forward direction voltages $V_F$ supplied to the respective EL elements through the respective switches $Sh_1$ to $Sh_n$ are also supplied to the sampling/holding circuit 8, thereby the forward direction voltages $V_F$ of the respective EL elements can be obtained.

In FIG. 1, while the sampled values from the respective switches $Sh_1$ to $Sh_n$ are supplied to the sampling/holding circuit 8 through a single connection line for the convenience of illustration, actually, discrete forward direction voltages are supplied to the sampling/holding circuit 8, respectively. Each forward direction voltage held by the sampling/holding circuit 8 is supplied to one of the input terminals (inverted input terminal) of an error amplifier 10 through a voltage division circuit composed of resistors $R_5$ and $R_6$. In contrast, a reference voltage Vref is supplied to the other of the input terminal (non-inverted input terminal) of the error amplifier 10, and thus a comparison output (error output) between the forward direction voltage and the reference voltage is created from the error amplifier 10.

Then, the output from the error amplifier 10 is supplied to one of the input terminals (non-inverted input terminal) of a differential amplifier 11. Further, the output from resistors $R_7$ and $R_8$ that divide the output voltage $V_H$ of a drive voltage source 6 is supplied to the other of the input terminals (inverted input terminal) of the differential amplifier 11. Therefore, the output voltage value of the differential amplifier 11 includes both the output information of the forward direction voltages $V_F$ of the EL elements and the output information of the output voltage $V_H$ of the drive voltage source 6.

In the embodiment shown in FIG. 1, a voltage increasing type DC-DC converter is used as the drive voltage source 6, and the output from the differential amplifier 11 is supplied to a switching regulator circuit 14 constituting the DC-DC converter. Note that while the drive voltage source 6 composed of the DC-DC converter that will be described below creates a direct current output by pulse width modulation (PWM) control, it may utilize pulse frequency modulation (PFM) control.

The switching regulator circuit 14 includes a PWM circuit 15 and a reference oscillator 16 disposed therein. The output from the differential amplifier 11 is supplied to the PWM circuit 15. The PWM circuit 15 modulates the pulse width of the signal supplied from the reference oscillator 16 so that an npn transistor $Q_2$ is switched in response to the pulse output modulated by the PWM circuit 15. That is, the electric power energy from a direct current voltage source 12 is accumulated in an inductor $L_1$ by turning on the transistor $Q_2$. In contrast, the electric power energy accumulated in the inductor $L_1$ is accumulated in a capacitor $C_1$ through a diode $D_3$ by turning off the transistor $Q_2$.

Then, an increased DC output voltage can be obtained as the terminal voltage of the capacitor $C_1$ by repeating the turning-on/off operation of the transistor $Q_2$, and the DC output acts as the output voltage $V_H$ output from the drive voltage source 6. Accordingly, in this embodiment, the output voltage $V_H$ depends on the forward direction voltages $V_F$ when the EL elements are lit.

Further, in this embodiment, the output voltage $V_H$ is controlled also by the output voltage divided by the resistors $R_7$ and $R_8$. Thus, the respective constant current circuits $I_1$ to $I_n$ of the anode line drive circuit 2 can be controlled to have a given voltage drop value that permits the constant current circuits $I_1$ to $I_n$ to guarantee a constant current drive by appropriately selecting the voltage dividing ratio of the resistors $R_7$ and $R_8$. With this arrangement, the power loss in the respective constant current circuits $I_1$ to $I_n$ can be reduced as much as possible.

In contrast, a control signal can be sent from the light emission control circuit 4 to a voltage forcibly changing circuit 9. The voltage forcibly changing circuit 9 sends a command signal to the PWM circuit 15 in the switching regulator circuit 14 based on the control signal so as to forcibly increase the voltage $V_H$ output from the drive voltage source 6.

FIG. 2 explains a cathode reset method making use of the reverse bias voltage $V_M$ created in the drive circuit arranged above as a precharge voltage of the light-emitting elements. The cathode reset operation is executed by driving the drive switches $S_{X1}$ to $S_{Xn}$ in the anode line drive circuit 2 and by driving the scan switches $S_{Y1}$ to $S_{Ym}$ in the cathode line scan circuit 3 in response to the control signal from the light emission control circuit 4 described above.

Note that FIG. 2 shows from a state in which, for example, an EL element $E_{11}$ connected to the first anode drive line $A_1$ is driven for light emission to a state in which an EL element $E_{12}$ connected to the same first anode drive circuit A1 is driven for light emission in the next scan. In FIG. 2, EL elements that are being driven for light emission are shown by a symbol mark of a diode and the other EL elements are shown by a symbol mark of a capacitor.

FIG. 2(*a*) shows the state in which the cathode scan line $B_1$ is scanned and the EL element $E_{11}$ is emitted before the cathode reset operation is executed. The EL element $E_{12}$ is emitted by the next scan. However, the anode drive line $A_1$ and all the cathode scan lines $B_1$ to $B_m$ are set to a ground potential so as to discharge all the charges as shown in FIG. 2(*b*) before the EL element $E_{12}$ is emitted. This is executed by connecting the respective scan switches $S_{Y1}$ to $S_{Ym}$ shown in FIG. 1 to the ground as well as by connecting the drive switch $S_{X1}$ connected to the first drive line $A_1$ to the ground.

Next, the cathode scan line $B_2$ is scanned so that the EL element $E_{12}$ is emitted. That is, the cathode scan line $B_2$ is connected to the ground, and the reverse bias voltage $V_M$ is supplied to the cathode scan lines other than the cathode scan line $B_2$. Note that, at this time, the drive switch $S_{X1}$ is isolated from the ground and connected to the constant current circuit $I_1$.

The charges of the parasitic capacitances of the respective EL elements are discharged in the reset operation shown in FIG. 2(*b*) described above, the parasitic capacitances of the EL elements other than the EL element $E_{12}$ which is emitted next are charged with the reverse bias voltage $V_M$ in a reverse direction as shown by an arrow at the moment as shown in FIG. 2(*c*), and the current charged to these EL elements flows to the EL element $E_{12}$ which is emitted next through the anode drive line $A_1$ and charges (precharges) the EL element $E_1$. At this time, the constant current source $I_1$ connected to the drive line $A_1$ does not influence the behavior of the charged current because it is basically a high impedance circuit as described above and.

In this case, when it is assumed, for example, that 64 pieces of EL elements are disposed to the anode drive line $A_1$ and that the reverse bias voltage $V_M$ described above is 10 V, the potential $V(A_1)$ of the anode drive line $A_1$ is instantly precharged to the potential based on the following equation 1 by the charge operation described above because the wiring impedance in the display panel can be ignored because it is too small. For example, in a display panel whose outside dimension is 100 mm×25 mm (256×64 dots), this operation is completed in about 1 μsec.

$$V_{(A1)}=(V_M\times 63+0V\times 1)/64=9.84\text{V}$$

Thereafter, the EL element $E_{12}$ is instantly put into a light emitting state by the drive current flowing in the drive line $A_1$ and supplied from the constant current circuit $I_1$ as shown in FIG. 2(*d*). As described above, the cathode reset method acts to instantly rise up the forward voltage of the EL elements which are lit next making use of the parasitic capacitances of the EL elements that essentially obstruct the drive of the EL element and the reverse bias voltage for preventing crosstalk emission.

Incidentally, in the drive circuit arranged as shown in FIG. 1, the forward direction voltages $V_F$ of an element in a light emitting state is obtained by the sampling/holding circuit 8, and the voltage $V_H$ output from the drive voltage source 6 is controlled by the forward direction voltage $V_F$. Then, the reverse bias voltage $V_M$ created based on the output voltage $V_H$ is used as the precharge voltage making use of the cathode reset method to thereby hasten the rising-up of the light emission of the element.

However, the output voltage $V_H$ from the drive voltage source 6 is controlled by a feed-back loop through the sampling/holding circuit 8 described above. Thus, when, for example, the light emission display panel 1 starts to be driven for light emission, the rising-up of the output voltage $V_H$ from the drive voltage source 6 is delayed by the influence of sampling intervals (intervals of several hundreds of millisecond). Accordingly, a problem is arisen in that the rising-up of the reverse bias voltage $V_M$ used as the precharge voltage of the elements is also delayed and a sufficient precharge voltage cannot be obtained. As a result, a light emission start operation is executed slowly at the time the light emitting display panel 1 starts to be driven for light emission.

Further, this is also arisen similarly when the light emission luminance of the light-emitting display panel 1 is to be increased while it is being driven for light emission. That is, there is arisen such a situation that the precharge voltage cannot be sufficiently obtained in correspondence to the light emission luminance to be increased and that the precharge voltage badly follows a command for increasing the light emission luminance.

To cope with this problem, when, for example, the light-emitting display panel 1 starts to be driven for light emission, the control signal is sent from the light emission control circuit 4 to the voltage forcibly changing circuit 9 in the embodiment shown in FIG. 1. With this operation, the voltage forcibly changing circuit 9 sends a command signal to the PWM circuit 15 in the switching regulator circuit 14 to thereby forcibly increase the degree of modulation of the pulse width of a signal supplied from the reference oscillator 16 in the PWM circuit 15 for a predetermined time so that the operation time of the npn transistor $Q_2$ is increased when it is turned on.

In this case, in a preferable example, the output voltage $V_H$ that can be generated by the drive voltage source 6 composed of the DC-DC converter is set to a maximum value. With this operation, the reverse bias voltage $V_M$, which is utilized as the precharge voltage of the elements, also is instantly set to a maximum value, thereby the respective light-emitting elements of the light-emitting display panel 1 are almost instantly risen up to a set light emitting state. This is executed similarly also when the light emission luminance of the light-emitting display panel 1, which is being driven for light emission, is to be increased. That is, the precharge voltage can be instantly increased likewise by sending the control signal from the light emission control circuit 4 to the voltage forcibly changing circuit 9, thereby the following property of the light emission luminance can be improved.

The output voltage $V_H$ that can be generated from the drive voltage source 6 is set to the maximum value when the display panel 1 starts to be driven for light emission or when the light emission luminance is to be increased in the example described above. However, when the light emission luminance is to be increased while the display panel 1 is being driven for light emission, the output voltage $V_H$ may be controlled to a predetermined voltage value in correspondence to a degree of increase of light emission luminance.

In this case, a table as to the degree of modification, which corresponds to the degree of increase of light emission luminance, of the pulse width in the PWM circuit 15 is disposed in, for example, the voltage forcibly changing circuit 9, and data of the degree of modification is read from the table based on light emission luminance increase command data supplied from the light emission control circuit 4. With this operation, an appropriate precharge voltage (reverse bias voltage $V_M$) can be obtained according to the degree of increase of light emission luminance by controlling the degree of modification of the pulse width in the PWM circuit 15.

Note that the output voltage $V_H$ from the drive voltage source 6 is entirely increased forcibly when the display panel 1 starts to be driven for light emission or when the light emission luminance is to be increased in the above description. However, the output voltage $V_H$ may be increased forcibly when, for example, the light emission luminance of the light-emitting display panel, which is being driven for light emission, is increased beyond a predetermined range.

That is, when the increase in the light emission luminance of the display panel 1 does not reach the predetermined range, a change of luminance is not so remarkable. In this case, light emission luminance may be increased according to the sampling intervals of the sampling/holding circuit 8.

Note that, in the above explanation, the forward direction voltages of the respective EL elements whose lighting is controlled by the constant current circuits $I_1$ to $I_n$ provided with the anode line drive circuit 2 are sampled and held as a means for obtaining the forward direction voltages $V_F$ of the light elements as shown in FIG. 1. However, an arrangement shown in FIG. 3 may be preferably used as the means for obtaining the forward direction voltages $V_F$ of the EL elements.

That is, in the arrangement shown in FIG. 3, a dummy organic EL element Ex that does not contribute to light emission is formed as a film on the display panel 1 together with organic EL elements for display, and a constant current is supplied to the dummy organic EL element Ex through a constant current circuit 21 driven by the output voltage $V_H$. Then, the anode terminal of the dummy organic EL element Ex is connected to the inverted input terminal of an operational amplifier 22 and the cathode terminal thereof is grounded as well as connected to the non-inverted input terminal of the operational amplifier 22.

The operational amplifier 22 constitutes a known negative feedback amplifier having a feedback resistor $R_9$ connected from the output terminal of the operational amplifier 22 to the inverted input terminal thereof, and the output from the operational amplifier 22 is supplied to the sampling/holding circuit 8 shown in FIG. 1. According to this arrangement, the forward direction voltages $V_F$ of the EL elements can be obtained at all times making use of the dummy organic EL element Ex, thereby the switches $Sh_1$ to $Sh_n$, and the like as shown in FIG. 1 can be omitted.

Note that when the arrangement shown in FIG. 3 is employed, the dummy organic EL element Ex is also lit. Thus, it is preferable to provide a masking for concealing the lit state of the dummy organic EL element Ex as necessary. Further, while the above description has been made as to the example in which the forward direction voltages of the EL elements are obtained from the anode terminals thereof, they may be obtained from the cathode terminals thereof.

While the above explanation has been made as to the passive matrix drive system as the example, the present invention is by no means limited to the passive matrix drive system and also can be applied to an active matrix drive system. FIG. 4 shows an arrangement for lighting and driving one EL element as to an example for driving the EL element by a constant current in the active matrix drive system. This active matrix system ordinarily includes a data driver 31 for outputting data signals corresponding to the respective pixels composed of EL elements to respective data lines $Y_1$, $Y_2$, . . . and a scan driver 32 for outputting addressing output signals to respective scan lines $X_1$, $X_2$, . . . .

Then, a drive current is supplied to the EL element $E_{11}$ constituting the pixel from the output voltage source $V_H$ through a driving transistor (thin film transistor) $Q_3$. In this case, a switching circuit 33 is connected to the gate electrode of the driving transistor $Q_3$. When the switching circuit 33 receives an addressing output from the scan driver 32 through the scan line $X_1$, the switching circuit 33 captures the data signal supplied from the data driver 31 through the data line $Y_1$.

The switching circuit 33 has a function for turning on/off the driving transistor $Q_3$ and a function for correcting the dispersion of the constant current, thereby the switching circuit 33 acts to control the gate voltage of the driving transistor $Q_3$ and to supply the constant current to the EL element 11 constituting the pixel. That is, in the example shown in FIG. 4, a constant current drive circuit 34 is composed of the switching circuit 33 and the transistor $Q_3$.

Therefore, this invention can be preferably applied also to the active matrix drive system in which EL elements are driven for light emission by the constant current drive as shown in FIG. 4 and can realize a light emission display device in which light emission luminance can be instantly followed similarly to the passive matrix drive system.

As apparent from the above description, according to the display device making use of the drive system of the present invention, the voltage output from the drive voltage source is forcibly changed to a predetermined voltage value, for example, when the light-emitting display panel is starts to be driven for light emission or the light emission luminance of the light-emitting display panel, which is being driven for light emission, is to be increased. Accordingly, the rising-up property of the light-emitting display panel and the following property of luminance can be improved.

What is claimed is:

1. A drive method of a light-emitting display panel including light-emitting elements whose lighting is controlled through constant current circuits, comprising the steps of:

supplying constant currents to the light-emitting elements from the constant current circuits making use of the voltage output from a drive voltage source;

controlling the voltage output from the drive voltage source based on the forward direction voltages of the light-emitting elements; and forcibly changing the voltage output from the drive voltage source according to the change of the drive conditions of the light-emitting elements.

2. A drive method of a light-emitting display panel according to claim 1, wherein when the light-emitting display panel starts to be driven for light emission, the voltage output from the drive voltage source is forcibly changed to a predetermined voltage value.

3. A drive method of a light-emitting display panel according to claim 1, wherein when the light emission luminance of the light-emitting display panel that is being drive for light emission is to be increased, the voltage output from the drive voltage source is forcibly changed to a predetermined voltage value.

4. A drive method of a light-emitting display panel according to claim 1, wherein when the light emission luminance of the light-emitting display panel that is being driven for light emission is to be increased beyond a predetermined range, the voltage output from the drive voltage source is forcibly changed to a predetermined voltage value.

5. A light-emitting display panel according to any of claims 2 to 4, wherein the predetermined voltage value is set to a maximum value of an output voltage that can be generated from the voltage drive source.

6. A light-emitting display panel according to claim 3 to 4, wherein the predetermined voltage value is set to a voltage value predetermined in correspondence to a degree of increase of light emission luminance.

7. A drive method of a light-emitting display panel according to claim 1, wherein the forward direction voltages are sampled at the timing at which the constant currents are supplied from the constant current circuits to the light-emitting elements, and the forward direction voltages are obtained by a sampling/holding circuit for holding the sampled voltage values.

8. A drive method of a light-emitting display panel according to any of claims 1 to 4, wherein the forward direction voltages are obtained by adding a constant current to a dummy light-emitting element that does not contribute to the light emission of the light-emitting display panel.

9. A drive method of a light-emitting display panel according to any of claims 1 to 4, wherein a voltage drop in the constant current circuits is controlled substantially constant by controlling the voltage output from the drive voltage source.

10. A drive method of a light-emitting display panel according to claim 5, wherein a voltage drop in the constant current circuits is controlled substantially constant by controlling the voltage output from the drive voltage source.

11. A drive method of a light-emitting display panel according to claim 6, wherein a voltage drop in the constant current circuits is controlled substantially constant by controlling the voltage output from the drive voltage source.

12. A drive method of a light-emitting display panel according to any of claims 1 to 4, wherein a voltage increasing type DC-DC converter is used as the drive voltage source.

13. An organic EL display device, wherein the light-emitting elements comprise organic EL elements driven for light emission by a drive method according to any of claims 1 to 4.

14. An organic EL display device, wherein the light-emitting elements comprise organic EL elements driven for light emission by a drive method according to claim 5.

15. An organic EL display device, wherein the light-emitting elements comprise organic EL elements driven for light emission by a drive method according to claim 6.

16. An organic EL display device, wherein the light-emitting elements comprise organic EL elements driven for light emission by a drive method according to claim 7.

17. An organic EL display device, wherein the light-emitting elements comprise organic EL elements driven for light emission by a drive method according to claim 9.

18. An organic EL display device, wherein the light-emitting elements comprise organic EL elements driven for light emission by a drive method according to claim 10.

19. An organic EL display device, wherein the light-emitting elements comprise organic EL elements driven for light emission by a drive method according to claim 12.

20. An organic EL display device, wherein the light-emitting elements comprise organic EL elements driven for light emission by a drive method according to claim 11.

* * * * *